US007125097B2

(12) United States Patent
Sekiguchi

(10) Patent No.: US 7,125,097 B2
(45) Date of Patent: Oct. 24, 2006

(54) INK-JET PRINTING HEAD IN WHICH EACH PASSAGE BETWEEN PRESSURE CHAMBER AND NOZZLE INCLUDES HORIZONTALLY EXTENDING PORTION

(75) Inventor: Yasuhiro Sekiguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 192 days.

(21) Appl. No.: 10/676,229

(22) Filed: Sep. 30, 2003

(65) Prior Publication Data

US 2004/0066430 A1 Apr. 8, 2004

(30) Foreign Application Priority Data

Oct. 4, 2002 (JP) ..... 2002-292502

(51) Int. Cl.
*B41J 2/155* (2006.01)
*B41J 2/14* (2006.01)
*B41J 2/05* (2006.01)

(52) U.S. Cl. ..... 347/42; 347/47; 347/63

(58) Field of Classification Search ..... 347/42–44, 347/48, 68, 72, 40, 47, 54, 63
See application file for complete search history.

(56) References Cited

U.S. PATENT DOCUMENTS 5,489,930 A * 2/1996 Anderson ..... 347/1
2002/0024567 A1* 2/2002 Takagi ..... 347/72

FOREIGN PATENT DOCUMENTS

| | | |
|---|---|---|
| EP | 600743 A2 * | 6/1994 |
| JP | 7-195685 | 8/1995 |
| JP | 2002-36545 | 2/2002 |
| JP | 2002-59547 | 2/2002 |

* cited by examiner

*Primary Examiner*—Shih-Wen Hsieh
(74) *Attorney, Agent, or Firm*—Reed Smith LLP

(57) ABSTRACT

An ink-jet printing head including a cavity unit and an actuator superposed on each other. The cavity unit is provided by a plurality of plates superposed on each other in a vertical direction of the cavity unit, and has (a) a plurality of nozzles arranged in at least one row, (b) a plurality of pressure chambers arranged in a direction of the above-described at least one row of the nozzles, and (c) a plurality of communication passages for communication between the respective pressure chambers and the respective nozzles. The pressure chambers are arranged with a first spacing pitch between each adjacent pair of the pressure chambers, except at least one adjacent pair of the pressure chambers which are spaced apart from each other by a second spacing pitch that is larger than the first spacing pitch. Each of the communication passages includes at least one horizontally extending portion which extends in parallel with a horizontal direction of the cavity unit.

26 Claims, 10 Drawing Sheets

INK-JET PRINTING HEAD IN WHICH EACH PASSAGE BETWEEN PRESSURE CHAMBER AND NOZZLE INCLUDES HORIZONTALLY EXTENDING PORTION

This application is based on Japanese Patent Application No. 2002-292502 filed in Oct. 4, 2002, the contents of which are incorporated hereinto by reference.

BACKGROUND OF THE INVENTION

1. Field of the Invention

The present invention relates in general to an ink-jet printing head, and more particularly to the construction of a large-sized ink-jet printing head having a large number of nozzles arranged in at least one row.

2. Discussion of Related Art

A prior art ink-jet printing head of on-demand type, as disclosed in JP-A-2002-59547 (equivalent to US Patent Application Publication US 2002/0024567 A1), for example, includes a cavity unit consisting of a plurality of plates superposed on each other so as to define ink delivery passages. These plates include a nozzle plate having a plurality of nozzles, a base plate partially defining pressure chambers corresponding to the respective nozzles, and manifold plates partially defining common ink chambers in the form of manifold chambers which communicate with an ink supply source and the above-indicated pressure chambers. The ink-jet printing head further includes a piezoelectric actuator which has piezoelectric ceramic plates, and internal electrodes in the form of common electrodes and arrays of individual electrodes formed on the piezoelectric ceramic plates such that the common electrodes and the individual electrode arrays are alternately superposed on each other. The piezoelectric actuator and the cavity unit are bonded together such that active portions existing between the common electrode and the respective individual electrodes are aligned with the respective pressure chambers.

In an ordinary ink-jet printer known in the art, a printing operation is performed by an ink-jet printing head in a direction of width of a recording medium such as a sheet of paper, which direction is perpendicular to a direction of feeding of the recording medium. The direction of width and the direction of feeding of the paper sheet will be respectively referred to as "primary scanning direction" and "secondary scanning direction" where appropriate. The printing operation is performed such that rows of the nozzles of the ink-jet printing head are parallel to the direction of feeding of the paper sheet (the secondary scanning direction). In this arrangement, images can be printed during each one movement of the carriage in the primary scanning direction, in the corresponding area of the paper sheet whose dimension in the secondary scanning direction is substantially equal to the length of each row of the nozzles. For example, the ink-jet printing head has a plurality of parallel rows of nozzles, each of which has a length of one inch (25.4 mm) and consists of 72 nozzles, and the nozzles in the parallel rows are arranged such that the nozzles of one row and the nozzles of the adjacent row are positioned in a zigzag pattern. In this case, the area in which a printing operation is performed on the paper sheet during one movement of the ink-jet printing head in the primary scanning direction has a dimension of one inch in the secondary scanning direction.

To meet recent demands for an increased printing speed and an improved quality of printed images, there has been a need for increasing the length of the rows of the nozzles to about two inches, for instance, by increasing the number of the nozzles in each row while maintaining the spacing pitch of the nozzles (dot-to-dot distance) in the secondary scanning direction. For increasing the length of each row of the nozzles with an increase in the number of the nozzles in each row, the nozzles and pressure chambers can be formed in the plates of the cavity unit, with the nominal spacing pitches or distances with high accuracy, irrespective of the number of the nozzles and pressure chambers, where the nozzles and pressure chambers are formed by laser machining or etching operations in those plates formed of a metallic or synthetic material.

For providing each piezoelectric ceramic plate of the piezoelectric actuator with the active portions corresponding to the respective nozzles, on the other hand, the length of the piezoelectric ceramic plate should necessarily be increased with an increase in the number of the nozzles.

As known in the art, the piezoelectric actuator is fabricated by pressing and then firing a laminar structure wherein piezoelectric ceramic plates each having the common electrode formed thereon in a predetermined pattern and piezoelectric ceramic plates each having the individual electrodes formed in a predetermined pattern are alternately superposed on each other. Generally, the dimensions of the piezoelectric ceramic plates in the directions of length, width and thickness are reduced due to shrinkage of the plates as a result of a firing operation. In particular, the amount of shrinkage of the piezoelectric ceramic plates in the direction of length (i.e., in the direction of the rows of the nozzles) is considerably large. The spacing distance between the adjacent individual electrodes in the direction of length of the piezoelectric plates is determined with the above-indicated amount of shrinkage (shrinkage ratio) taken into account.

In the presence of variations in the fabrication of the piezoelectric ceramic plates, such as variations in the dimensional accuracy and firing temperature, however, it becomes more and more difficult to match the spacing distance between the adjacent individual electrodes formed on the fired piezoelectric ceramic plates, with the spacing distance of the adjacent pressure chambers, as the length of the piezoelectric ceramic plates is increased. Such a difficulty leads to an increased risk of defect of the printing head as a product.

SUMMARY OF THE INVENTION

It is therefore an object of the present invention to solve a problem associated with fabricating a piezoelectric actuator that is relatively long in the direction of a row of nozzles. The present invention provides a piezoelectric actuator formed by arranging a plurality of actuator units into a single piezoelectric actuator, instead of increasing the length of the piezoelectric actuator in the direction of the row of nozzles. In this arrangement, each of the plurality of actuator units arranged in the direction of the row of nozzles has a length covering a corresponding one of groups of the pressure chambers. The pressure chambers in each of the groups are equally spaced apart from each other by a relatively small pitch. However, a pitch between the adjacent pressure chambers belonging to the respective different groups has to be relatively large due to a pitch between the actuator units. The nozzles should be equally spaced apart from each other although the pitch between adjacent pressure chambers located across the two actuator units is different from the pitch of the other pressure chambers. For this reason, each of the nozzles has to be offset from a corresponding one of the pressure chambers in the direction of the row of nozzles toward opposed ends of the two actuator units. The pressure chamber and the nozzle which are offset from each other can be brought into communication with each other by a communication passage, as disclosed in JP-A-H07-195685 and JP-A-2002-36545, which is generally inclined with respect to a vertical direction of the cavity unit in which the plates are superposed on each other.

Each communication passage disclosed in JP-A-H07-195685 is provided by a plurality of through-holes formed through the respective plates of the cavity unit. Each of the through-holes is offset from its adjacent one of the through-holes by a small distance, so that the communication passage is generally inclined with respect to the vertical direction. Each communication passage of JP-A-2002-36545 is different from the communication passage of JP-A-H07-195685 in that each of the through-holes providing the communication passage is inclined with respect to a thickness direction of the corresponding plate, rather than being parallel with respect to the thickness direction. The communication passage of JP-A-2002-36545 can be formed to be inclined with respect to the vertical direction, without formation of a step at the boundary or interface between each adjacent pair of the plates in an inner circumferential surface of the communication passage.

Although the pressure chamber and the nozzle which are offset from each other can be held in communication with each other by the inclined communication passage as disclosed in JP-A-H07-195685 and JP-A-2002-36545, such an inclined communication passage can not be easily formed, because it is not so easy to accurately position each adjacent pair of the through-holes relative to each other when the plates are superposed on each other. Further, where the number of the superposed plates located between the pressure chambers and the nozzles is small, the communication passage of JP-A-H07-195685 would suffer from a large step formed along a boundary between each adjacent pair of the plates in an inner circumferential surface of the communication passage. Where the spacing distance between the actuator units is considerably larger than the spacing distance between each adjacent pair of the nozzles, namely, where the communication passage has to be inclined with respect to the vertical direction by a large angle, each of the inclined through-holes providing the communication passage of JP-A-2002-36545 has to be considerably inclined with respect to the thickness direction of the corresponding plate. In this case, it becomes difficult to form each through-hole through the corresponding plate such that its openings in the opposite surfaces of the plate are offset from each other by a large distance.

It is therefore another object of the present invention to provide a relatively large-sized ink-jet printing head which has a relatively large number of nozzles and which is easy and economical to develop and manufacture. The objects of the invention may be achieved according to any one of the following modes of the present invention, each of which is numbered like the appended claims and depends from the other mode or modes, where appropriate, to indicate and clarify possible combinations of elements or technical features. It is to be understood that the present invention is not limited to the technical features or any combinations thereof which will be described for illustrative purpose only. It is to be further understood that a plurality of elements or features included in any one of the following modes of the invention are not necessarily provided all together, and that the invention may be embodied without some of the elements or features described with respect to the same mode.

(1) An ink-jet printing head comprising a cavity unit and an actuator which are superposed on each other, wherein the cavity unit is a laminar structure including a plurality of plates superposed on each other in a vertical direction of the cavity unit, and has (a) a plurality of nozzles which are open in a surface thereof that is to be opposed to a print media and which are arranged in at least one row, (b) a plurality of pressure chambers which are arranged in a direction of the at least one row of the nozzles, (c) a plurality of communication passages for communication between the respective pressure chambers and the respective nozzles, and (d) a manifold portion which stores an ink supplied from an ink supply source and re-fills the pressure chambers, wherein the actuator has a plurality of active portions which correspond to the pressure chambers, respectively, and which are selectively operable to eject the ink from the corresponding nozzles, wherein the pressure chambers are arranged with a first spacing pitch between each adjacent pair of the pressure chambers, except at least one adjacent pair of the pressure chambers which are spaced apart from each other by a second spacing pitch that is larger than the first spacing pitch, and wherein each of the communication passages includes at least one horizontally extending portion which extends in parallel with a horizontal direction of the cavity unit.

In the ink-jet head printing head constructed according to this mode (1) of the invention in which each communication passage (communicating with the corresponding pressure chambers and the corresponding nozzle which are offset from each other in the direction of the rows of the nozzles) includes the horizontally extending portion or portions, each communication passage does not have to include a portion which is inclined with respect to the vertical direction of the cavity unit. Owing to the absence of such an inclined portion in each communication passage, the cavity unit of the printing head can be easily manufactured. Where the image resolution of the printing head has to be changed, namely, where the arrangement of the nozzles has to be changed, such a change can be made by simply modifying the shape of the horizontally extending portion or portions of each communication passage, without having to change the arrangements of the actuator and the pressure chambers.

(2) An ink-jet printing head according to mode (1), wherein the actuator includes a plurality of mutually independent actuator units which are disposed such that end faces of each of at least one adjacent pair of the actuator units are opposed to each other in the direction of the at least one row of the nozzles, each of the actuator units having a length covering a predetermined number of the pressure chambers which are arranged in the direction of the at least one row of the nozzles, and wherein the end faces of each of the at least one adjacent pair of the actuator units are located between a corresponding one of the at least one adjacent pair of the pressure chambers which are spaced apart from each other by the second spacing pitch.

In the ink-jet head printing head constructed according to this mode (2) of the invention in which the actuator is provided by the plurality of actuator units, the spacing pitch between the adjacent active portions of the actuator and the spacing pitch between the adjacent pressure chambers of the cavity unit can be easily matched even where a large number of nozzles are formed in the cavity unit.

(3) An ink-jet printing head according to mode (1) or (2), wherein each of the communication passages consists of the at least one horizontally extending portion and at least one vertically extending portion which extends in parallel with the vertical direction of the cavity unit.

(4) An ink-jet printing head according to mode (3), wherein each of the at least one horizontally extending portion is provided by a horizontally extending recess which is formed in a recess-defining plate that is one of the plates and which extends in a direction parallel to the recess-defining plate.

(5) An ink-jet printing head according to mode (4), wherein each of the pressure chambers is elongated in a direction perpendicular to the direction of the at least one row of the nozzles, and is held in communication at a longitudinal end portion thereof with a corresponding one of the communication passages, and wherein the horizontally extending recess has opposite end portions, one of which is aligned with the longitudinal end portion of a corresponding one of the pressure chambers in the vertical direction of the cavity unit, and the other of which is aligned with a corresponding one of the nozzles in the vertical direction.

(6) An ink-jet printing head according to mode (4) or (5), wherein the pressure chambers include first and second pressure chambers which are alternately arranged in the direction of the at least one row of the nozzles, wherein the communication passages include first and second communication passages which are alternately arranged in the direction of the at least one row of the nozzles, and which communicate with the first and second pressure chambers, respectively, and wherein the recess providing each of the at least one horizontally extending portion of each of the first communication passages is formed in one of opposite surfaces of the recess-defining plate, while the recess providing each of the at least one horizontally extending portion of each of the second communication passages is formed in the other of the opposite surfaces of the recess-defining plate.

(7) An ink-jet printing head according to mode (6), wherein the recess providing each of the at least one horizontally extending portion of each of the first communication passages has a first depth value, while the recess providing each of the at least one horizontally extending portion of each of the second communication passages has a second depth value, and wherein a sum of the first depth value and the second depth value is smaller than a thickness value of the recess-defining plate.

In the ink-jet head printing head constructed according to this mode (7) of the invention, the recess of each first communication passage and the recess of each second communication passage are formed in the respective opposite surfaces of the recess-defining plate, wherein the sum of the depth value of the recess of each first communication passage and depth value of the recess of each second communication passage is smaller than the thickness value of the recess-defining plate. This arrangement permits the recess of each first communication passage and the recess of each second communication passage to be respectively configured or positioned to close to or overlap with each other in the plane of the recess-defining plate, without risk of communication between the recess of each first communication passage and the recess of each second communication passage. That is, this arrangement leads to a remarkably increased degree of freedom in designing the communication passages of the cavity unit.

(8) An ink-jet printing head according to mode (4) or (5), wherein the horizontally extending recess is formed in one of opposite surfaces of the recess-defining plate that is closer to the pressure chambers.

(9) An ink-jet printing head according to any one of modes (2)–(8), wherein the plurality of mutually independent actuator units include two actuator units as each of the at least one adjacent pair of the actuator units, wherein the plurality of pressure chambers include two groups of pressure chambers which correspond to the two actuator units, respectively, wherein the communication passages include two groups of communication passages which are held in communication with the two groups of pressure chambers, respectively, and wherein the communication passages of one of the two groups and the communication passages of the other of the two groups are formed symmetrically with each other with respect to a plane which is parallel to the vertical direction and which is perpendicular to the direction of the at least one row of the nozzles.

Where each communication passage consists of the horizontally extending portion and the vertically extending portion in the ink-jet head printing head constructed according to this mode (9) of the invention, the horizontally extending portions of the above-described one of the two groups and the horizontally extending portions of the above-described other of the two groups may be formed symmetrically with each other, while the vertically extending portions of the two groups may be formed to be identical with each other.

(10) An ink-jet printing head according to any one of modes (4)–(8), wherein the pressure chambers are formed in a pressure-chamber-defining plate which is one of the plates and which is contiguous to the recess-defining plate.

(11) An ink-jet printing head according to any one of modes (4)–(8) and (10), wherein the pressure chambers are formed in a pressure-chamber-defining plate which is one of the plates, and wherein the recess-defining plate is interposed between the pressure-chamber-defining plate and at least one of the plates in which the manifold portion is formed.

In the ink-jet head printing head constructed according to the mode (10) or (11) of the invention, the recess of each communication passage can be fluid-tightly closed at its opening by one of the plates that is contiguous to the recess-defining plate. Thus, the horizontally extending portion of each communication passage can be defined by the recess and the plate contiguous to the recess-defining plate.

(12) An ink-jet printing head according to any one of modes (1)–(11), wherein the nozzles arranged in each of the at least one row are spaced apart from each other by the first spacing pitch.

In the ink-jet head printing head constructed according to this mode (12) of the invention, the spacing pitch of the nozzles is equal to the spacing pitch of the nozzles. This arrangement permits the use of an already developed or existing actuator to manufacture a large-sized high-speed ink-jet printing head which has the same basic functions as an existing printing head including the existing actuator and which is operable with the same drive voltage and at the same timing as in the existing printing head.

(13) An ink-jet printing head according to any one of modes (1)–(12), wherein the nozzles are arranged in four rows, and wherein the active portions of the actuators are arranged in four rows each of which is parallel to a corresponding one of the four rows of the nozzles.

This mode (13) of the invention provides a compact full-color ink-jet printing head.

(14) An ink-jet printing head according to any one of modes (3)–(8), (10) and (11), wherein each of the at least one horizontally extending portion extends in a direction inclined with respect to the direction of the at least one row of the nozzles.

(15) An ink-jet printing head according to mode (5), wherein one of the opposite end portions of the horizontally extending recess is larger in area than the other.

(16) An ink-jet printing head according to mode (7), wherein the first and second communication passages which are adjacent to each other overlap partially in a plan view of the cavity unit.

(17) An ink-jet printing head according to any one of modes (1)–(16), wherein the actuator includes a first piezoelectric sheet formed with individual electrodes and a second piezoelectric sheet formed with a common electrode, the first and second piezoelectric sheets being superposed on each other, and wherein the active portions are defined between the individual electrodes and the common electrode.

(18) An ink-jet printing head according to any one of modes (1)–(17), wherein the pressure chambers are arranged in two rows in a zigzag pattern, wherein the nozzles are arranged in two rows in a zigzag pattern which are located between the two rows of the pressure chambers, and wherein the communication passages are arranged in two rows in a zigzag pattern each of which is located between a corresponding one of the two rows of the nozzles and a corresponding one of the two rows of the pressure chambers.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENTS

Figure 1:
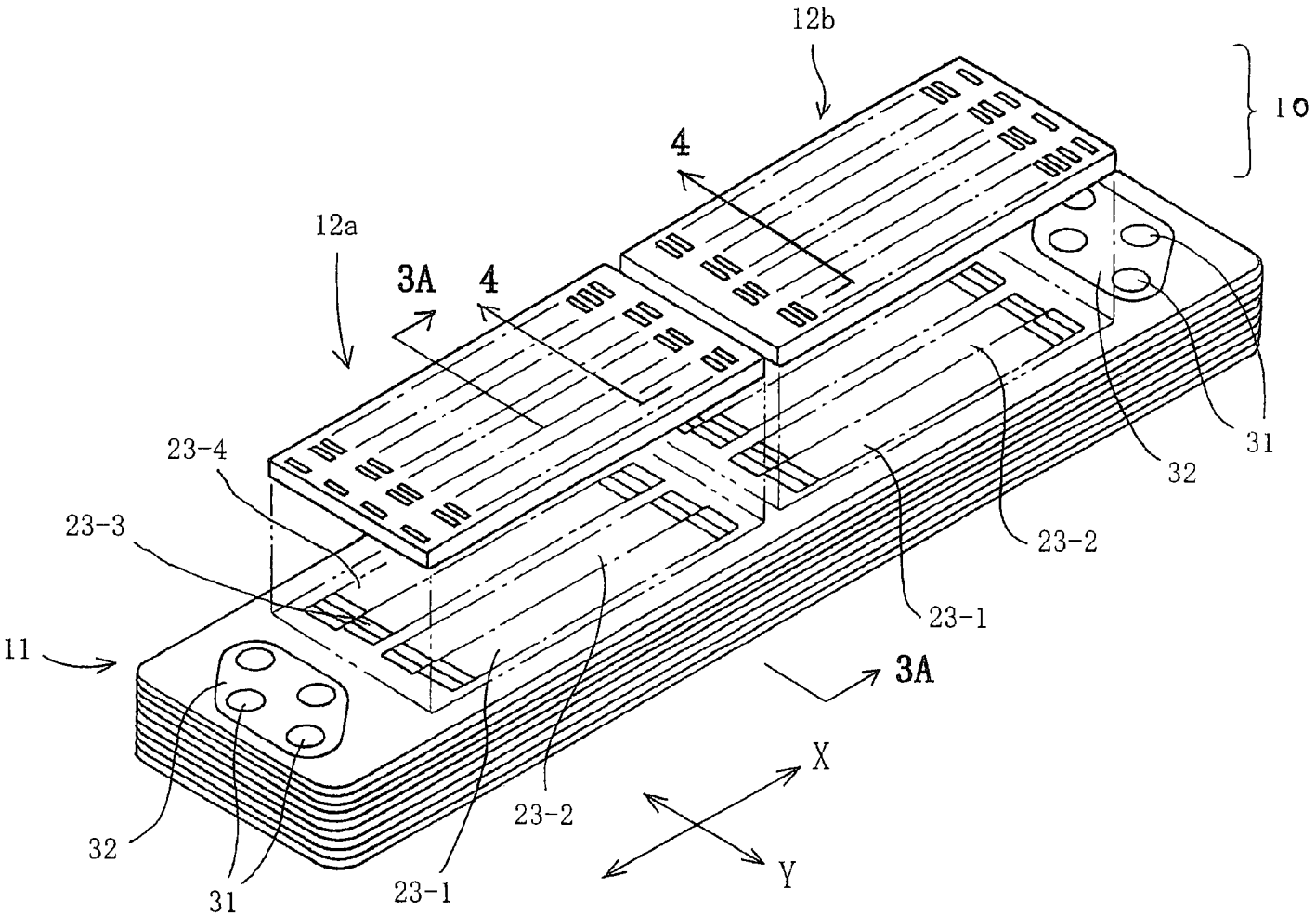
FIG. 1 is a perspective explosive view showing a cavity unit and a piezoelectric actuator of an ink-jet printing head of piezoelectric type according to one embodiment of this invention.
Figure 3A:
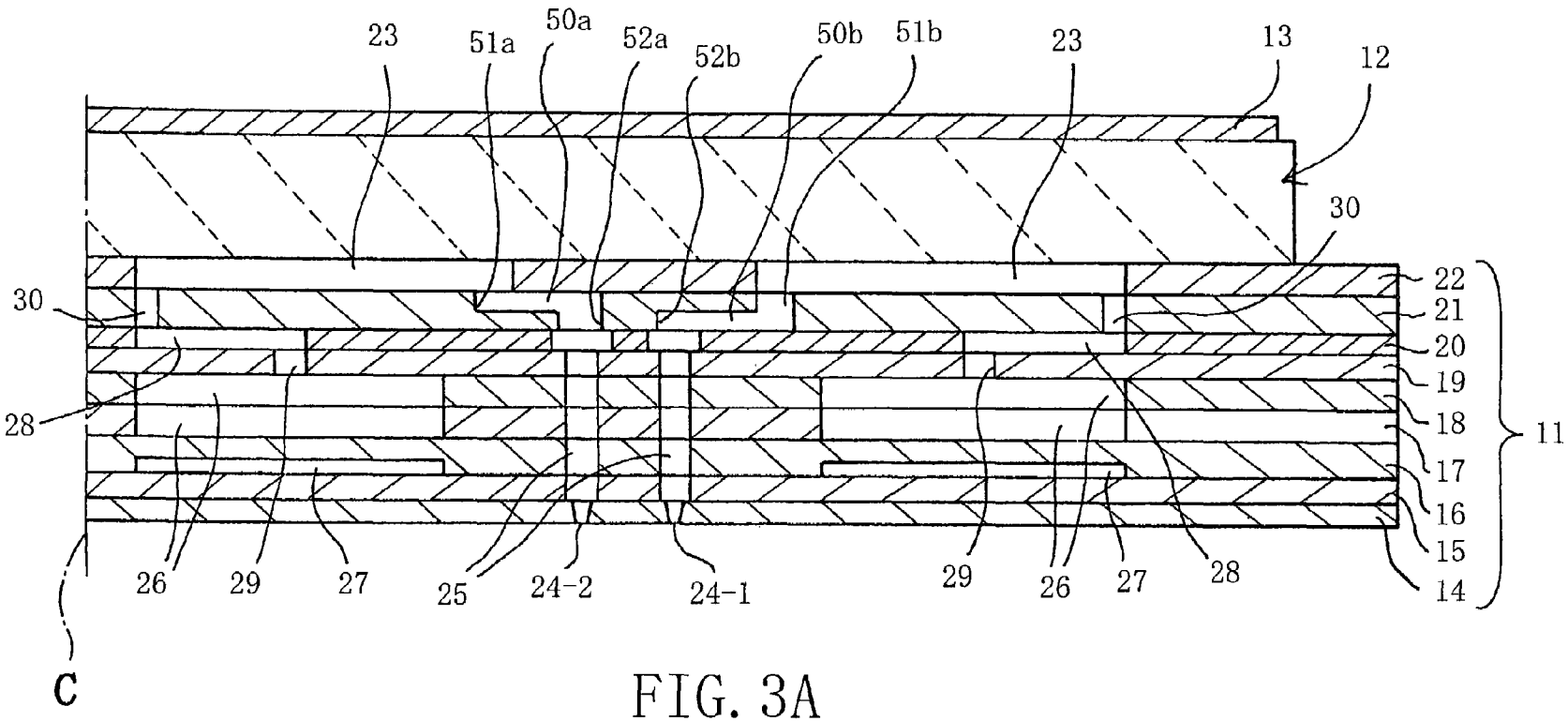
FIG. 3A is an elevational view in cross section taken along line 3A—3A of FIG. 1.
Figure 4:
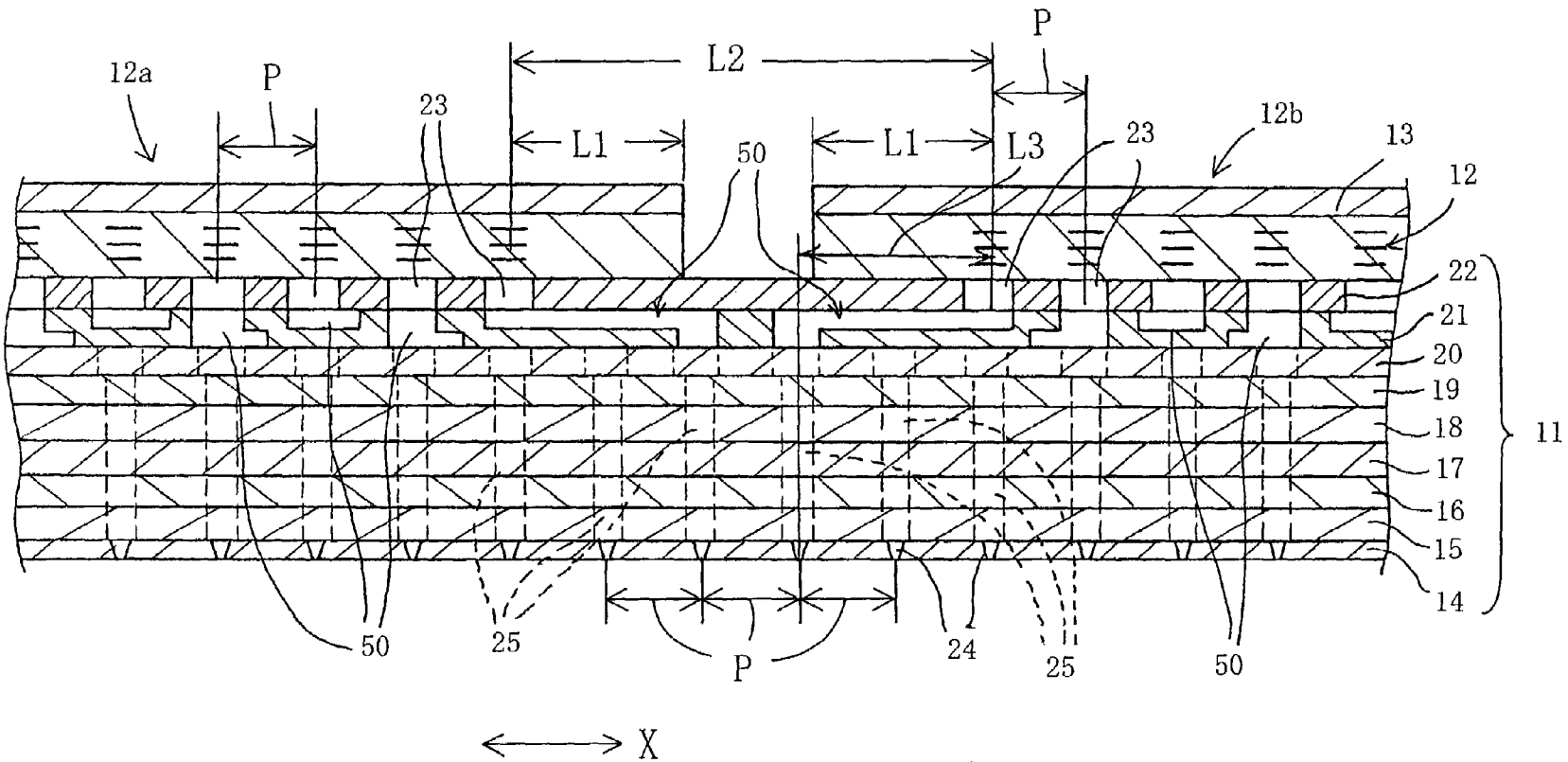
FIG. 4 is an elevational view in cross section taken along line 4—4 of FIG. 1.

Referring first to FIG. 1, the ink-jet printing head 10 of piezoelectric type constructed according to one embodiment of the present invention includes a cavity unit 11 and a piezoelectric actuator 12 which are superposed on each other in a vertical direction of the printing head 10. The piezoelectric actuator 12, which is of a planar type, is bonded to an upper surface of the cavity unit 11, and a flexible flat cable 13 for connection with an external device is superposed on and bonded by an adhesive to an upper surface of the planar piezoelectric actuator 12, as shown in FIGS. 3A and 4.

Figure 2:
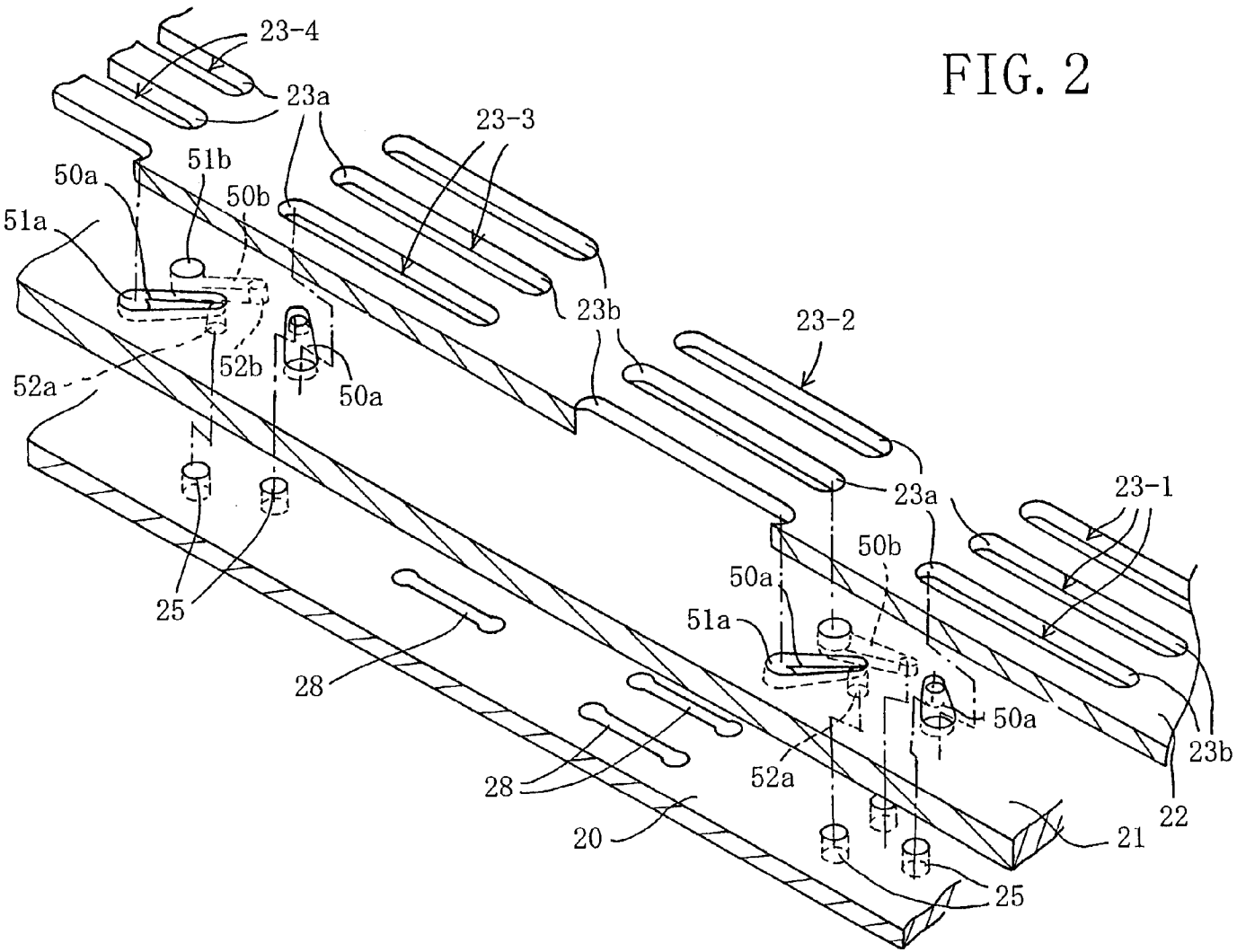
FIG. 2 is a fragmentary perspective explosive view of the cavity unit.

The above-indicated cavity unit 11 is constructed as shown in FIGS. 2–6. Described in detail, the cavity unit 11 is a laminar structure consisting of a total of nine relatively thin plates superposed on each other (in the vertical direction of the cavity unit 11) and bonded together by an adhesive. The nine thin plates consist of a nozzle plate 14, a cover plate 15, a damper plate 16, two manifold plates 17, 18, three spacer plates 19, 20, 21, and a base plate 22 which has a plurality of pressure chambers 23. The nine plates 14–22 are arranged in the order of description, with the nozzle plate 14 and the base plate 22 being a lowermost plate and an uppermost plate of the cavity unit 11, respectively. In the present embodiment, the nozzle plate 14 is formed of a synthetic resin, while the other plates 15–22 are formed from plates of a steel alloy including 42% of nickel and have thickness values of about 50–150 μm. It is noted that FIG. 2 is a fragmentary perspective view showing the base plate 22 as the uppermost plate, and the two spacer plates 21, 20 which are positioned on the lower side of the base plate 22.

The above-indicated nozzle plate 14 has nozzles 24 which are open in a lower surface of the cavity unit 11 that is to be opposed to a print media. Each of the nozzles 24 has an extremely small diameter (about 25 μm in this embodiment). The nozzles 24 are arranged in four parallel rows extending in a first direction of the nozzle plate 14 (in the longitudinal direction of the cavity unit 11, which is an X-axis direction indicated in FIGS. 1 and 4), such that the nozzles 24-1 and 24-2 in the respective two adjacent rows are arranged in a zigzag pattern, while the nozzles 24-3 and 24-4 in the respective two other adjacent rows are also arranged in a zigzag pattern.

That is, the multiple nozzles 24*a* in the first row and the multiple nozzles 24*b* in the second row are arranged at a predetermined small pitch P along respective two parallel reference lines (not shown) extending in the above-indicated first direction, such that each of the nozzles 24-1 is positioned between the adjacent nozzles 24-2 as viewed in the direction of extension of the reference lines, whereby the nozzles 24-1 and the nozzles 24-2 are arranged in a zigzag pattern or in a staggered fashion. Similarly, the multiple nozzles 24-3 in the third row and the multiple nozzles 24-4 in the fourth row are arranged at the predetermined small pitch P along respective two parallel reference lines extending in the first direction, such that each of the nozzles 24-3 is positioned between the adjacent nozzles 24-4 as viewed in the direction of extension of the reference lines, whereby the nozzles 24-3 and the nozzles 24-4 are arranged in the zigzag pattern or staggered fashion. A set consisting of the first and second rows of the nozzles 24-1, 24-2 is spaced by a suitable distance from a set consisting of the third and fourth rows of the nozzles 24-3, 24-4, as viewed in a second direction of the nozzle plate 14 (in the transverse or width direction of the cavity unit 11, which is a Y-axis direction indicated in FIGS. 1 and 3). In the present specific example, each of the first, second, third and fourth rows has a length of two inches, and consists of a total of 150 nozzles 24, so that the present ink-jet printing head 10 has an image resolution of 75 dpi (dots per inch) in the first or X-axis direction, with the 75 nozzles 24 existing per inch. FIG. 3A is a view in cross section, taken in a plane parallel to the Y-axis direction, of a portion of the ink-jet printing head 10 which portion is located on the right side of a widthwise center line C of the printing head 10. In this FIG. 3A, one of the nozzles 24-1 and one of the nozzles 24-2 are shown, while the nozzles 24-3, 24-4 are not shown.

The plurality of pressure chambers 23, which are formed in the base plate 22 as the uppermost plate of the cavity unit 11, are arranged in four parallel rows extending in the first direction, like the nozzles 24. The pressure chambers 23-1 in the first row are held in communication with the respective nozzles 24-1 in the first row. Similarly, the pressure chambers 23-2 in the second row are held in communication with the respective nozzles 24-2 in the second row. The pressure chambers 23-3 in the third row are held in communication with the respective nozzles 24-3 in the third row. The pressure chambers 23-4 in the fourth row are held in communication with the respective nozzles 24-4 in the fourth row.

There will next be described a positional relationship of the pressure chambers 23 formed in the base plate 22 of the cavity unit 11, relative to active portions of two actuator units 12*a*, 12*b* of the piezoelectric actuator 12 which are disposed on the base plate 22 such that the two actuator units 12*a*, 12*b* are arranged or spaced apart from each other in the direction of the rows of the nozzles 24 (in the first direction).

Each piezoelectric actuator unit 12*a*, 12*b* is arranged to activate the pressure chambers 23 corresponding to the nozzles 24 in a half of the length of each of the four rows, that is, 75 pressure chambers 23. Namely, the first piezoelectric actuator unit 12*a* is formed on the first half of the upper surface of the cavity unit 11 as seen in the longitudinal direction (in the first direction described above), while the second piezoelectric actuator unit 12*b* is formed on the other or second half of the upper surface, as shown in FIGS. 1 and 4.

As described below in detail with reference to FIG. 9, each piezoelectric actuator unit 12*a*, 12*b* consists of a laminar structure consisting of piezoelectric sheets 33, 34 and a top sheet 35 (which will be described) superposed on each other, such that the piezoelectric sheets 33 having individual electrodes 36 formed thereon and the piezoelectric sheets 34 having common electrodes 37 formed thereon are alternately laminated. The piezoelectric sheets 33, 34 have the above-indicated active portions between the individual electrodes 36 and the common electrodes 37. Upon application of a voltage between the selected individual electrodes 36 and the common electrodes 37, the active portions corresponding to the selected individual electrodes 36 are strained due to a longitudinal piezoelectric effect in the direction of lamination of the piezoelectric actuator unit 12*a*, 12*b*. The active portions are arranged in four rows corresponding to the respective four rows of the pressure chambers 23, and the active portions of each row correspond to the respective pressure chambers 23 of the corresponding row.

That is, the four rows of the active portions of each piezoelectric actuator unit 12*a*, 12*b* are parallel to the four rows of the nozzles 24 (pressure chambers 23) extending in the first direction, and are spaced apart from each other in the second direction. Each of the active portions is elongated in the above-indicated second direction (direction of width of the cavity unit 11), which is the longitudinal direction of each pressure chamber 23. The active portions have the same spacing pitch P as the pressure chambers 23 in the longitudinal direction of the cavity unit 11, such that the active portions of the four rows are arranged in a zigzag pattern, as is apparent from FIG. 9.

The pressure chambers 23 are arranged in two groups which correspond to the respective two piezoelectric actuator units 12*a*, 12*b* and which are arranged and spaced apart from each other in the longitudinal direction of the base plate 22. Namely, the pressure chambers 23 of the first group corresponding to the first piezoelectric actuator unit 12*a* correspond to the nozzles 24 in the first half of each row as seen in the direction of the row (in the first direction), while the pressure chambers 23 of the second group corresponding to the second piezoelectric actuator unit 12*b* correspond to the nozzles 24 in the second half of each row. The pressure chambers 23 of each group are arranged in four rows, with the same spacing pitch P as the nozzles 24, such that the pressure chambers 23 in the first and second rows are positioned relative to each other in a zigzag pattern, while the pressure chambers 23 in the third and fourth rows are similarly positioned relative to each other in a zigzag pattern.

Each of the pressure chambers 23 is elongated in the direction of width of the base plate 22 (in the second direction), and is formed through the thickness of the base plate 22. Each of the pressure chambers 23 is held in communication, at one of its opposite longitudinal end portion 23*b*, with a manifold chamber 26 through a second ink passage 30, a flow restrictor 28 and a first ink passage 29 which are respectively formed through the spacer plates 21, 20, 19.

Each of the pressure chambers 23 is held in communication, at the other longitudinal end portion 23*a* as its communication portion, with the corresponding nozzle 24 via a corresponding one of communication passages which are formed through the spacer plates 21, 20, 19, manifold plates 18, 17, damper plate 16 and cover plate 15, which are located between the base plate 22 and the nozzle plate 14. Each of the communication passages includes a horizontally extending portion which extends in parallel with a horizontal direction of the printing head 10. The horizontally extending portion is provided by a horizontally extending recess 50 which is formed in the third spacer plate 21 as a recess-defining plate and extends in a direction parallel to the spacer plate 21, i.e., in a direction parallel to an upper or lower surface (one of opposite horizontal surfaces) of the spacer plate 21. The recess 50 has longitudinally opposite end portions, one of which is aligned with the communication portion 23*a* of the corresponding pressure chamber 23 in the vertical direction, and the other of which is aligned with the corresponding nozzle 24 in the vertical direction. In other words, one of the longitudinally opposite end portions of the recess 50 has the same position in the horizontal direction as the corresponding pressure chamber 23, while the other of the longitudinally opposite end portions of the recess 50 has the same position in the horizontal direction as the corresponding nozzle 24. That is, owing to the presence of the horizontally-extending recess 50, each nozzle 24 can be positioned in a position which is distant, by a distance L3 (as shown in FIG. 4) as measured in the first direction of the nozzle plate 14, from an intersection of the nozzle plate 14 with a straight line which extends from the communication portion 23*a* of the corresponding pressure chamber 23 in the vertical direction.

As shown in FIG. 4, the pressure chambers 23 in each of the two groups are equally spaced apart from each other at the pitch P, while two of the pressure chambers 23 respectively nearest to the mutually opposed longitudinal end faces of the actuator units 12*a*, 12*b* are spaced apart from each other by another pitch L2 which is larger than the pitch P. In other words, the pressure chambers 23 are arranged with the pitch P between each adjacent pair of the pressure chambers 23, except one adjacent pair of the pressure chambers 23 which belong to the respective different groups and which are spaced apart from each other by the relative large pitch L2. This relatively large pitch L2 is provided because it is difficult to fabricate the piezoelectric actuator units 12*a*, 12*b* such that a distance L1 between the individual electrode 36 at one end of each row and the adjacent end of the piezoelectric actuator unit 12*a* or 12*b* is equal to or smaller than a half of the pitch P of the individual electrodes 36. In view of this difficulty, the piezoelectric actuator units 12*a*, 12*b* are fabricated with the distance L1 being larger than the half of the pitch P, and with the pitch L2 being larger than the distance L1, such that the longitudinal end faces of the two piezoelectric actuator units 12*a*, 12*b* which are opposed to each other are spaced from each other by a suitable distance (L2−2×L1).

Figure 5A:
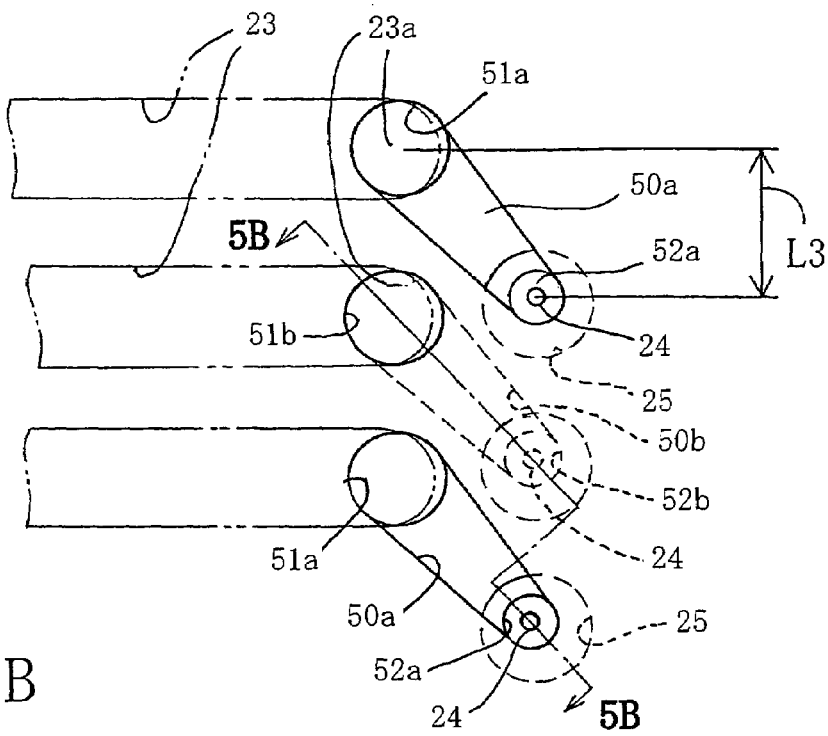
FIG. 5A is a plan view of communication passages of the cavity unit.

Each of the nozzles 24, which are equally spaced apart from each other at the pitch P, is positioned in the position which is distant, by the distance L3 (as shown in FIG. 4) in the first direction of the nozzle plate 14, from the intersection of the nozzle plate 14 with the straight line which extends from the communication portion 23*a* of the corresponding pressure chamber 23 in the vertical direction. Since the recess 50 (as the horizontally extending portion of each communication passage) horizontally extends form a portion of the plate 21 aligned with the communication portion 23*a*, up to a portion of the plate 21 aligned with the corresponding nozzle 24, the other portion of each communication passage can be provided by a vertically extending portion 25 which is provided by through-holes formed through the plates 16–20. It is noted that each of the recess 50 extends in a direction inclined with respect to the X-axis direction, rather than in parallel with the X-axis direction, so that the longitudinally opposite end portions of each recess 50 is distant from each other not only in the X-axis direction but also in the Y-axis direction, as shown in FIG. 5A. The recesses 50 corresponding to the two groups of pressure chambers 23 are inclined symmetrically with each other, with respect to a plane which is parallel to the vertical direction of the cavity unit 11 and which passes a midpoint of the distance (pitch) L2 of the two groups, as shown in FIG. 4. That is, the communication passages held in communication with the respective pressure chambers 23 of the first group and the communication passages held in communication with the respective pressure chambers 23 of the second group are formed symmetrically with each other with respect to the above-described plane, as shown in FIG. 4. It is also noted that each of the recesses 50 does not have to extend straight as seen in the plane of the plate 21 but may be curved. This curved configuration of the recess 50 is effective to prevent communication between each adjacent pair of the communication passages where each nozzle 24 is close to the communication portion 23*a* of the pressure chamber 23 of the adjacent communication passage (which is adjacent to the communication passage held in communication with the nozzle 24 in question).

Figure 5B:
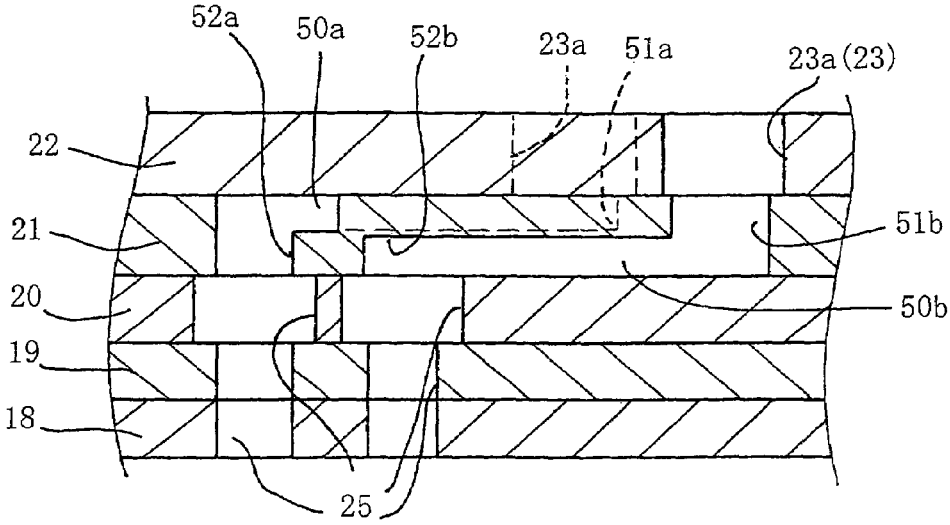
FIG. 5B is an elevational view in cross section taken along line 5B—5B of FIG. 1.
Figure 6:
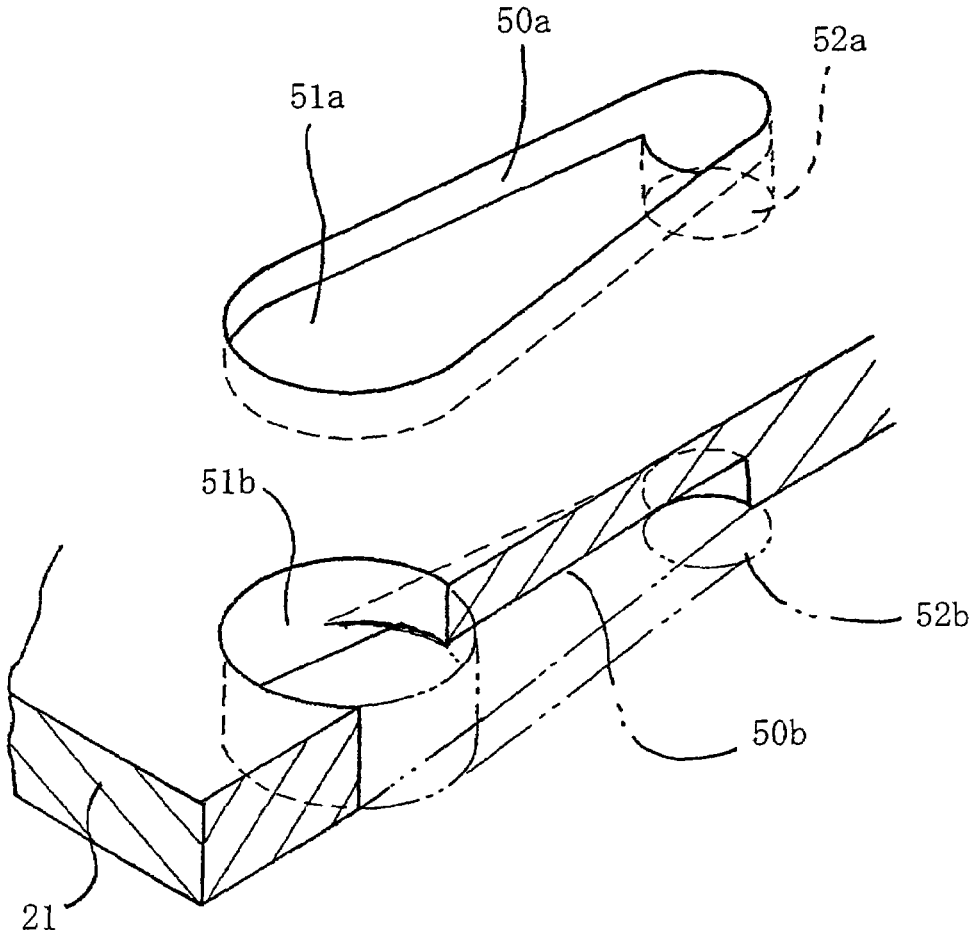
FIG. 6 is a perspective view of horizontally extending recesses of the communication passages.

The recesses 50 of the respective communication passages consist of first and second recesses 50*a*, 50*b* which are alternately arranged in the X-axis direction. Each of the first recesses 50*a* is open in the upper surface of the third spacer plate 21, while each of the second recesses 50*b* is open in the lower surface of the third spacer plate 21, as shown in FIGS. 5A, 5B and 6. The first and second recesses 50*a*, 50*b* are formed by etching such that each of the recesses 50*a*, 50*b* has a depth slightly smaller than a half of the thickness of the third spacer plate 21, as shown in FIG. 5B.

Each first recess 50*a* is fluid-tightly closed at its upper opening by the base plate 22 superposed on the third spacer plate 21, except one 51*a* of its longitudinally opposite end portions at which the first recess 50*a* is held in communication with the communication portion 23*a* of the corresponding pressure chamber 23, as best shown in FIG. 5B. A through-hole 52*a* is formed through a bottom wall of the other longitudinal end portion of each first recess 50*a*, so that the first recess 50*a* is held in communication at the other longitudinal end portion with the vertically extending portion 25 which is provided by the through-holes formed through the plates 16–20.

Each second recess 50*b* is fluid-tightly closed at its lower opening by the second spacer plate 20 underlying the third spacer plate 21, except one 52*b* of its longitudinally opposite end portions at which the second recess 50*b* is held in communication with the vertically extending portion 25 which is provided by the through-holes formed through the plates 16–20. A through-hole 51*b* is formed through a bottom wall of the other longitudinal end portion of each second recess 50*b*, so that the second recess 50*b* is held in communication at the other longitudinal end portion with the communication portion 23*a* of the corresponding pressure chamber 23.

Each of the recesses 50*a*, 50*b* has a width which is gradually decreased as the recess 50*a*, 50*b* extends away from the portion of the plate 21 aligned with the communication portion 23*a* of the corresponding pressure chamber 23, toward the portion of the plate 21 aligned with the corresponding nozzle 24. Therefore, the longitudinal end portion 51*a* (at which the first recess 50*a* is held in communication with the corresponding pressure chamber 23) has a larger area of ink flow than that of the other longitudinal end portion which is contiguous to the through-hole 52*a*. The longitudinal end portion 52*b* (at which the second recess 50*b* is held in communication with the vertically extending portion 25 of the corresponding communication passage) has a smaller area of ink flow than that of the other longitudinal end portion which is contiguous to the through-hole 51*b*.

The alternate arrangement of the first recesses 50*a* (formed in the upper surface of the third spacer plate 21) and the second recesses 50*b* (formed in the lower surface of the third spacer plate 21) makes it possible to position the adjacent first and second recesses 50*a*, 50*b* relative to each other such that the first and second recesses 50*a*, 50*b* are close to each other as seen in the plane of the third spacer plate 21. This is because the adjacent first and second recesses 50*a*, 50*b* are spaced apart from each other in the vertical direction of the cavity unit 11. That is, there is no risk of communication between the adjacent first and second recesses 50*a*, 50*b*, even where the recesses 50*a*, 50*b* are close to each other in the horizontal direction of the cavity unit 11. Consequently, the alternate arrangement of the first and second recesses 50*a*, 50*b* leads to an increased degree of freedom in designing the communication passages of the cavity unit 11. It is noted that the vertically extending portion of each communication passage may be interpreted to be provided by not only the through-holes formed through the plates 16–20 but also a corresponding one of the above-described through-holes 52*a*, 51*b* formed through the bottom walls of the recesses 50.

Figure 7:
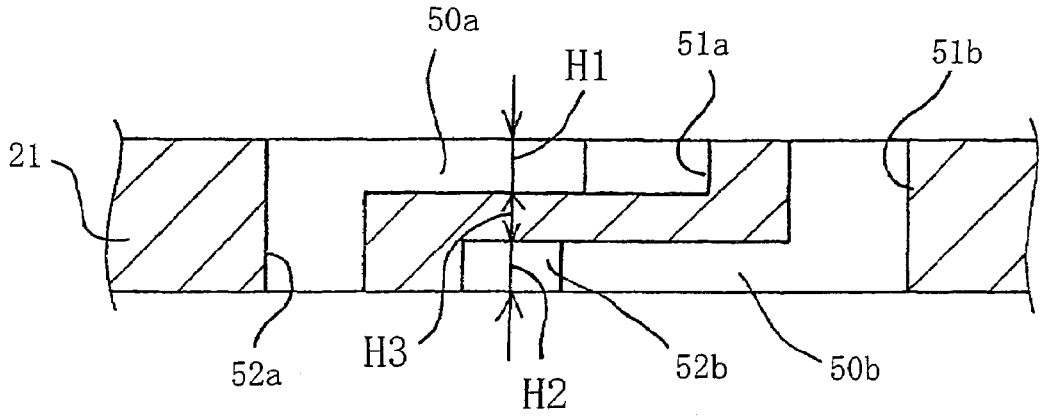
FIG. 7 is a cross sectional view of a modified arrangement of the horizontally extending recesses.

FIG. 7 shows a modified arrangement of the first and second recesses 50*a*, 50*b* of the communication passages in which the first and second recesses 50*a*, 50*b* are adapted to have respective values H1, H2 of depth. Since each of the depth values H1, H2 is about one-third of the thickness of the third spacer plate 21, there exists a non-recessed portion between the first and second recesses 50*a*, 50*b* in the thickness direction of the spacer plate 21. The non-recessed portion has a thickness H3 which is about one-third of the thickness of the spacer plate 21. This modified arrangement makes it possible to design the first and second recesses 50*a*, 50*b* such that the adjacent first and second recesses 50*a*, 50*b* are respectively configured or positioned to overlap with each other in the plane of the third spacer plate 21, without risk of communication between the adjacent first and second recesses 50*a*, 50*b*. The modified arrangement of FIG. 7 leads to a further increased degree of freedom in designing the communication passages of the cavity unit 11.

Figure 8A:
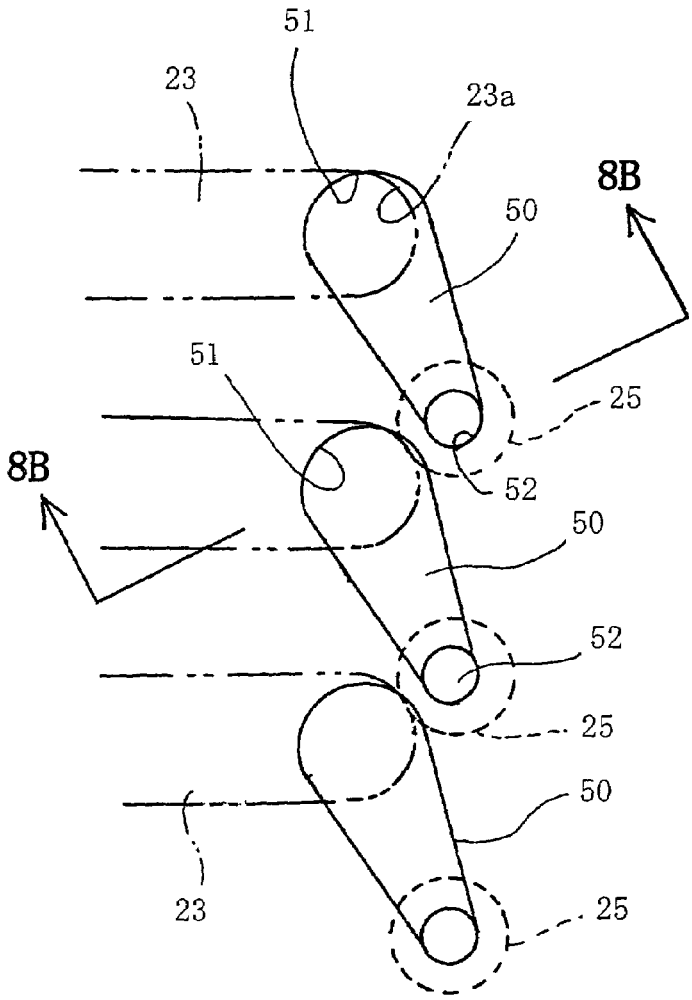
FIG. 8A is a plan view of another arrangement of the horizontally extending recesses.
Figure 8B:
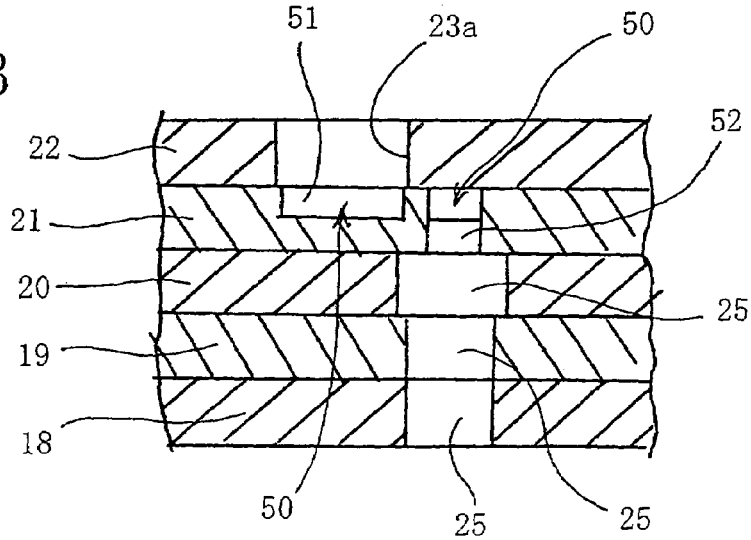
FIG. 8B is an elevational view in cross section taken along line 8B—8B of FIG. 8A.

FIGS. 8A and 8B show another modified arrangement of the recesses 50 as the horizontally extending portions of the communication passages in which all the recesses 50 are formed in the upper surface of the third space plate 21. In this modified arrangement, each nozzle 24 can be positioned to be close to the adjacent pressure chamber 23 (which is adjacent to the pressure chamber 23 held in communication with the nozzle 24 in question) in the horizontal direction of the cavity unit 11, such that the vertically extending portion 25 of each communication passage overlaps with the horizontally extending portion (recess) 50 of the adjacent communication passage in the horizontal direction, or such that the vertically extending portion 25 of each communication passage overlaps with the adjacent pressure chamber 23 (which is adjacent to the pressure chamber 23 communicating with the communication passage in question) in the horizontal direction. That is, even where each nozzle 24 is horizontally close to the adjacent pressure chamber 23 with or without a positioning error in the manufacturing process, there is no risk of communication between the vertically extending portion 25 of each communication passage and the horizontally extending portion (recess) 50 of the adjacent communication passage, because the vertically extending portion 25 and the horizontally extending portion (recess) 50 are spaced apart from each other in the vertical direction of the cavity unit 11. Thus, the arrangement shown in FIGS. 8A and 8B provides a high degree of freedom in determining the positions of the nozzles 24.

Further, in the arrangement shown in FIGS. 8A and 8B, the through-hole of the second spacer plate 20 (constituting a part of the vertically extending portion 25 of each communication passage) may have a diameter larger than that of the through-hole 52 formed through the bottom wall of the longitudinal end portion of each recess 50. Even with the large diameter of the through-hole of the second spacer plate 20, there is no risk of communication between the recess (horizontally extending portion) 50 of each communication passage and the vertically extending portion 25 of the adjacent communication passage.

According to the principle of the present invention, each of the communication passages, which communicate between the respective pressure chambers 23 and the respective nozzles 24, is constituted by the horizontally extending portion 50 and the vertically extending portion 25 which can be provided by the through-holes extending through the plates in the vertical direction of the cavity unit 11, i.e., in a direction perpendicular to the plates. The communication passages can be easily designed, even where each pressure chambers 23 is disaligned or distant from the corresponding nozzle 24 by a large distance in the horizontal direction, such that all the communication passages are adapted to have the same entire lengths, namely, such that the distances between the respective pressure chambers 23 and the respective nozzles 24 as measured along the respective communication passages are equal to one another.

The above-indicated two manifold plates 17, 18 partially define the manifold portion 26 in the form of mutually independent eight elongated manifold chambers 26, all of which extend in parallel with the rows of the nozzles 24. Described in detail, each of the manifold chambers 26 has a length corresponding to a fraction of the entire length of each row of the nozzles 24, more specifically, has a length which covers the length of each group of the pressure chambers 23 (i.e., the 75 pressure chambers 23 in each of the four rows of each group). Thus, the cavity unit 11 has a total of eight manifold chambers 26. Each of the elongated manifold chambers 26 is held at its longitudinal end portion in communication with a corresponding one of a total of eight ink supply passages 31 which are formed through the spacer plates 19–21 and the base plate 22. As shown in FIG. 1, four of the eight ink supply passages 31 are open in one of opposite longitudinal end portions of the upper surface of the base plate 22, while the other eight ink supply passages 31 are open in the other longitudinal end portions of the upper surface of the base plate 22. Two filters 32 are provided to cover these opposite longitudinal end portions of the upper surface of the base plate 22, for removing dirt or any other foreign matters that can be contained in the ink supplied from the ink supply source such as an ink reservoir.

Each of the manifold chambers 26 is formed through the entire thickness of each manifold plates 17, 18, for example, by etching, and is fluid-tightly closed at its upper and lower ends by the first spacer plate 19 superposed on the manifold plate 18 and the damper plate 16 underlying the manifold plate 17. The damper plate 16 has damper chambers 27 in the form of recesses formed in its lower surface by etching through a portion of its thickness. These damper chambers 27 have the same shape as the manifold chambers 26 as viewed in the plane of the damper plate 16.

The reverse component of the pressure wave of the ink in each pressure chamber 23 generated upon operation of the piezoelectric actuator 12 is absorbed by an oscillating motion of a relatively thin bottom wall of the damper chamber 27 formed in the damper plate 16, so that a cross talk which would otherwise occur between the adjacent pressure chambers 23 can be prevented.

Figure 3B:
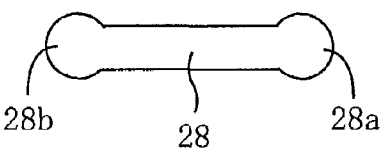
FIG. 3B is an enlarged plan view of a flow restrictor formed in the cavity unit.

The second spacer plate 20 partially defines the flow restrictors 28 formed in alignment with the respective pressure chambers 23. Each of these flow restrictors 28 has a shape as shown in FIG. 3B, as seen in the plane of the second spacer plate 20. That is, each flow restrictor 28 has a large area of ink flow at its longitudinal opposite end portions 28*a*, 28*b*, and a comparatively small area of ink flow at its intermediate portion 28*c*. Each flow restrictor 28 is elongated in the longitudinal direction of the corresponding pressure chamber 23. The flow restrictors 28 are fluid-tightly closed at their lower end by the first spacer plate 19 underlying the second spacer plate 20, and at their upper end by the third spacer plate 21 superposed on the second spacer plate 20. The first spacer plate 19 has first ink passages 29 each of which communicates with the corresponding manifold chamber 26 and the longitudinal end portion 28*a* of the corresponding flow restrictor 28, while the third spacer plate 21 has second ink passages 30 each of which communicates with the other longitudinal end portion 28*b* of the corresponding flow restrictor 28 and the end portion of the corresponding pressure chamber 23, as shown in FIG. 3A.

Figure 9:
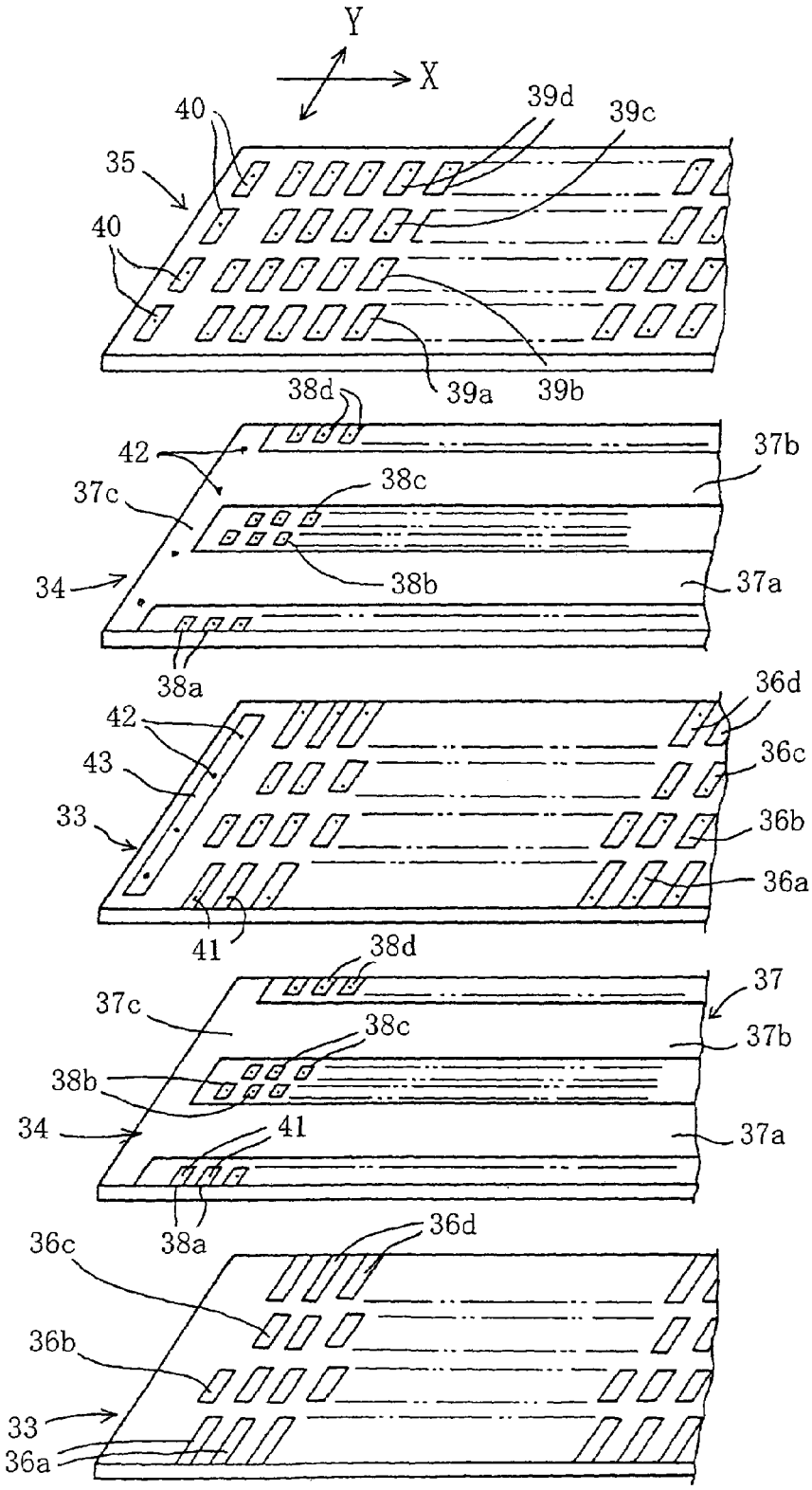
FIG. 9 is a fragmentary perspective view showing patterns of arrangement of individual electrodes and common electrodes of the piezoelectric actuator.

On the other hand, each of the two piezoelectric actuator units 12*a*, 12*b* which are two divisions of the actuator 12 is a laminar structure consisting of the above-indicated piezoelectric sheets 33, 34 and top sheet 35 superposed on each other, as shown in FIG. 9. Although only two piezoelectric sheets 33 and only two piezoelectric sheets 34 are shown in FIG. 9, the laminar structure may include a total of four to ten piezoelectric sheets 33, 34 alternately superposed on each other. Each of these piezoelectric sheets 33, 34 and top sheet 35 has a thickness of about 30 μm. As shown in FIG. 9, each of the piezoelectric sheets 33 has the individual electrodes 36 in the form of elongated strips which are aligned with the respective pressure chambers 23 of the cavity unit 11 and which are arranged in four rows (36*a*, 36*b*, 36*c*, 36*d*) parallel to the first direction (longitudinal direction of the piezoelectric sheets 33), which is parallel to the X-axis direction as indicated in FIG. 4 or the direction of the rows of the nozzles 24.

Each of the individual electrodes 36*a*, 36*b*, 36*c*, 36*d* in the four rows is elongated in the second direction (Y-axis direction), that is, in the direction of width of the piezoelectric sheets 33, and has a length substantially equal to that of each pressure chamber 23-1, 23-2, 23-3, 23-4 (see FIG. 2). However, the width of the individual electrode 36*a*–36*d* is slightly smaller than that of each pressure chamber 23. The first row of individual electrodes 36*a* and the fourth row of individual electrodes 36*d* are located near the respective opposite long side edges of the corresponding piezoelectric sheet 33.

The second row of individual electrodes 36*b* and the third row of individual electrodes 36*c* are located in a widthwise central portion of the corresponding piezoelectric sheet 33, between the first and fourth rows of individual electrodes 36*a*, 36*d* located adjacent to the opposite long side edges of the piezoelectric sheet 33. Each of the piezoelectric sheets 33 except the lowermost one has a dummy common electrode 43 aligned with a lead portion 37*c* of the common electrode 37 which will be described.

The common electrode 37 formed on the upper surface of each piezoelectric sheet 34 includes two main portions 37*a*, 37*b* which are elongated in the above-indicated first direction of the cavity unit 11 (in the X-axis direction or the longitudinal direction of the piezoelectric sheet 34), and the above-indicated lead portion 37*c* which is connected to the main portions 37*a*, 37*b* and which extends along one of the opposite short side edges of the piezoelectric sheet 34. The first main portion 37*a* is located in alignment with an almost entire portion of each individual electrode 36*a* in the first row and an almost entire portion of each individual electrode 36*b* in the second row, as viewed in the plane of the piezoelectric sheet 34. Each piezoelectric sheet 34 further has dummy electrodes 38*a*, 38*b* arranged in two rows located on the respective opposite sides of the first main portion 37*a* such that these dummy electrodes 38*a*, 38*b* in each row are equally spaced apart from each other, and such that each dummy electrode 38*a*, 38*b* is aligned with only a longitudinal end portion of the corresponding individual electrode 36*a*, 36*b* in the first and second rows, as viewed in the plane of the piezoelectric sheet 34.

Similarly, the second main portion 37*b* is located in alignment with an almost entire portion of each individual electrode 36*c* in the third row and an almost entire portion of each individual electrode 36*d* in the fourth row, as viewed in the plane of the piezoelectric sheet 34. Each piezoelectric sheet 34 further has dummy electrodes 38*c*, 38*d* arranged in two rows located on the respective opposite sides of the second main portion 37*b* such that these dummy electrodes 38*c*, 38*d* in each row are equally spaced apart from each other, and such that each dummy electrode 38*c*, 38*d* is aligned with only a longitudinal end portion of the corresponding individual electrode 36*c*, 36*d* in the third and fourth rows, as viewed in the plane of the piezoelectric sheet 34.

On the upper surface of the top sheet 35, there are formed four rows of surface electrodes 39*a*, 39*b*, 39*c*, 39*d* aligned with the respective four rows of the individual electrodes 36*a*, 36*b*, 36*c*, 36*d*, and four surface electrodes 40 aligned with the lead portion 37*c* of the common electrode 37 in the first direction. The piezoelectric sheets 33, 34 and top sheet 35 which are superposed on the lowermost piezoelectric sheet 33 have through-holes 41 formed through their thickness, and through the surface electrodes 39*a*, 39*b*, 39*c*, 39*d*, the individual electrodes 36*a*, 36*b*, 36*c*, 36*d* and the dummy electrodes 38*a*, 38*b*, 38*c*, 38*d*. These through-holes 41 are filled with an electrically conductive material (formed from an electrically conductive paste), for electrically connecting the surface electrodes 39*a*–39*d* with the individual electrodes 36*a*–36*d* and dummy electrodes 38*a*–38*d*. The above-indicated piezoelectric sheets 33, 34 and top sheet 35 further have through-holes 42 formed through their thickness and through the surface electrodes 40 on the top sheet 35, the lead portion 37*c* of the common electrode 37 on each piezoelectric sheet 34 and a dummy common electrode 43 formed on the upper piezoelectric sheet 33. These through-holes 42 are also filled with an electrically conductive material (electrically conductive paste), for electrically connecting the surface electrodes 40 with the lead portions 37*c* and the dummy common electrode 43.

To fabricate each piezoelectric actuator unit 12*a*, 12*b* of the piezoelectric actuator 12, unfired layers which give the individual electrodes 36, common electrodes 37, dummy electrodes 38, dummy common electrode 43, and surface electrodes 39, 40 are formed by screen printing using a suitable electrically conductive paste such as a paste of silver and palladium, on the surfaces of ceramic substrates which give the piezoelectric ceramic sheets 33, 34 and top sheet 35. After those layers are dried, the ceramic substrates are laminated on each other and fired into the piezoelectric sheets 33, 34 and top sheet 35 having the various electrodes indicated above. Obviously, the dummy electrodes 38*a*, 38*b*, 38*c*, 38*d* are formed at respective local spots, so as to avoid electrical continuity with each other and with the common electrodes 37, and the dummy common electrode 43 is formed at a local spot, so as to avoid electrical continuity with the individual electrodes 36.

Then, the lower surfaces of the two actuator units 12*a*, 12*b* of the piezoelectric actuator 12 thus constructed are entirely covered by respective layers or sheets (not shown) of an adhesive agent in the form of an ink impermeable synthetic resin, and the two actuator units 12*a*, 12*b* are bonded at those sheets of the adhesive agent to the upper surface of the cavity unit 11 such that the individual electrodes 36*a*–36*d* are aligned with the respective pressure chambers 23 formed in the cavity unit 11, as shown in FIGS. 3A and 4. Further, the flexible flat cable 13 is pressed onto the upper surface of each actuator unit 12*a*, 12*b*, such that electrically conductive wires (not shown) of the flexible flat cables 13 are electrically connected to the surface electrodes 39, 40.

Then, a predetermined high voltage is applied between all of the individual electrodes 36 and the common electrodes 37 through the surface electrodes 39, 40, for polarizing local portions of the piezoelectric sheets 33, 34 which are sandwiched between the respective individual electrodes 36 and the common electrodes 37. The thus polarized portions of the piezoelectric sheets 33, 34 function as the active portions of the actuator 12. In operation of the ink-jet printing head 10, an ink-jetting drive voltage is applied between the selected individual electrodes 36 and the common electrodes 37, through the surface electrodes 39, 40, to produce electric fields in the corresponding active portions, in the direction of polarization, so that the active portions are elongated in the direction of lamination of the piezoelectric sheets 34, 35, whereby the volumes of the corresponding pressure chambers 23 are reduced. As a result, the ink in the pressure chambers 23 are jetted as droplets from the corresponding nozzles 24, onto a print medium, so that an image in the form of ink dots is printed on the print medium.

Where a full-color printing operation is performed by the present ink-jet printing head 10, using inks of four colors (black, cyan, yellow and magenta), the first, second, third and fourth rows of nozzles 24-1, 24-2, 24-3 and 24-4 are respectively used for delivering the black, cyan, yellow and magenta inks, for example. In this case, the first manifold chambers 26 of the respective two groups formed in the manifold plates 17, 18 are filled with the black ink, and the second manifold chambers 26 are filled with the cyan ink. The third manifold chambers 26 are filled with the yellow ink, and the fourth manifold chambers 26 are filled with the magenta ink.

In the present embodiment, the pressure chambers 23 consist of two groups arranged in the direction of the rows of the nozzles 24 such that the two groups are spaced apart from each other by the relatively large spacing distance L2, while the nozzles 24 are equally spaced apart from each other at the predetermined relatively small pitch P (<L2), and the horizontally extending recess 50 constitutes at least a portion of each of the communication passages for communication between the respective pressure chambers 23 and the respective nozzles 24. Although the present ink-jet printing head 10 has a larger number of nozzles 24 than in an existing printing head having a smaller number of nozzles in each row and the same spacing pitch of the nozzles as in the present printing head, the piezoelectric actuator of the existing printing head which has a smaller length in the direction of the rows of the nozzles can be used as each of the two piezoelectric actuator units 12*a*, 12*b* of the piezoelectric actuator 12 of the present printing head 10, which are arranged in the direction of the rows of the nozzles 24.

Accordingly, each of the two piezoelectric actuator units 12*a*, 12*b* has a reduced amount of shrinkage due to firing of the actuator units, making it possible to reduce a variation in the spacing distance between the adjacent active portions, thereby permitting efficient manufacture of the piezoelectric actuator having a high degree of dimensional accuracy.

Where the existing ink-jet printing head has 75 nozzles (pressure chambers) arranged in each row in the longitudinal direction over a length of one inch, a desired ink-jet printing head wherein the length of each row of the nozzles is two or more inches can be efficiently fabricated by using a plurality of piezoelectric actuators of the existing ink-jet printing head.

Figure 10:
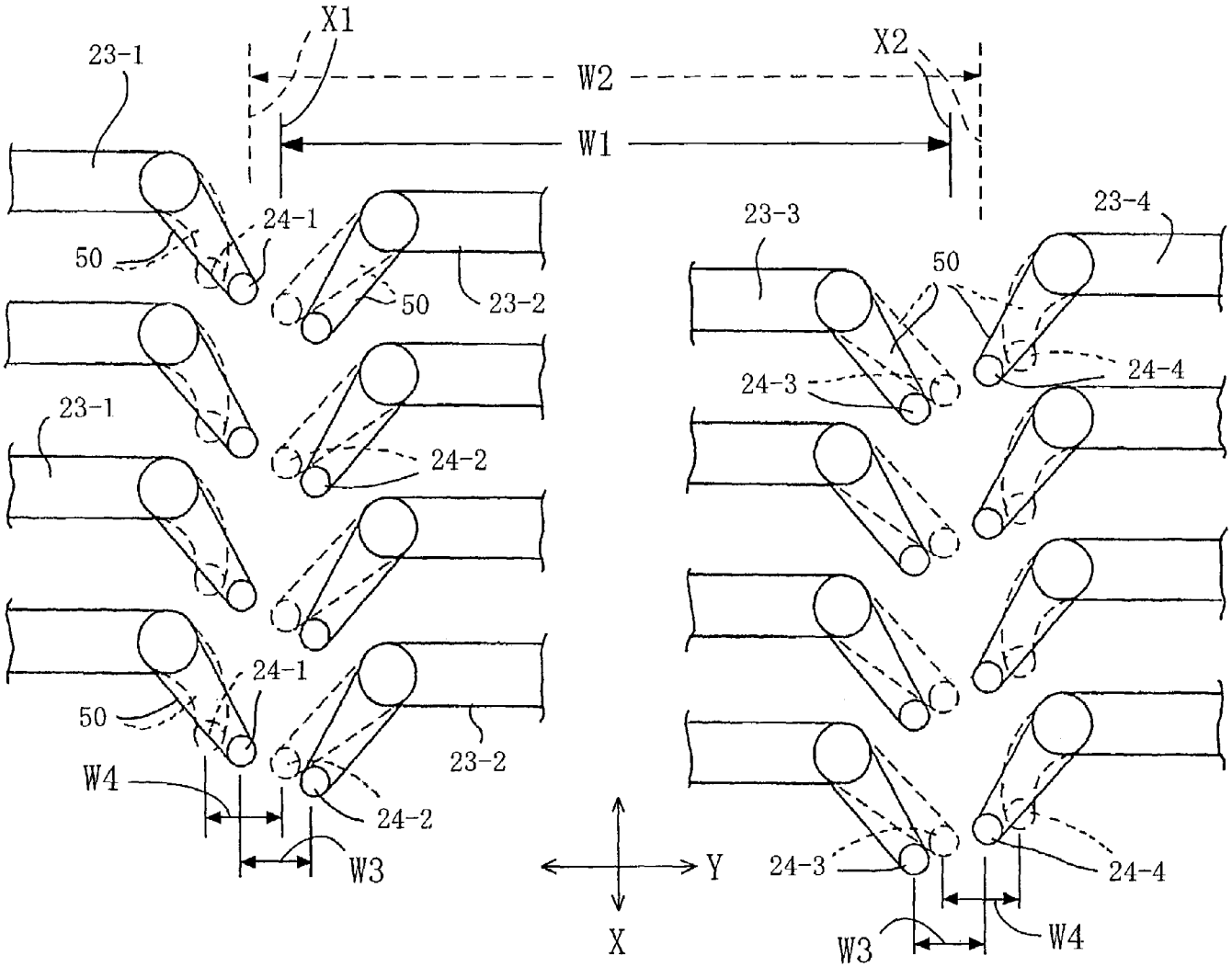
FIG. 10 is a plan view showing two patterns of arrangements of the horizontally extending recesses for establishing respective different image resolution values.

FIG. 10 is a plan view for explaining fabrications of ink-jet printing heads having different values of the image resolutions, without changing the positional relationship between the pressure chambers 23 of the cavity unit 11 and the active portions of the actuator 12.

As known in the art, the image resolution in the secondary scanning direction (i.e., X-axis direction) can be increased without reducing the spacing pitch of the nozzles in the secondary scanning direction, for example, by feeding a print media in such a manner that permits an additional dot to be printed between each adjacent pair of dots which are spaced apart from each other by a distance corresponding to the spacing pitch of the nozzles. On the other hand, with respect to the image resolution in the primary scanning direction (i.e., Y-axis direction), a distance between adjacent rows of nozzles has to be an integral multiple of the inverse of the image resolution value (e.g., 600 dpi or 150 dpi).

The plan view of FIG. 10 shows two patterns of the configurations or arrangements of the horizontally extending recess 50, one of which is represented by the solid lines, and the other of which is represented by the broken lines. For establishing a certain value of the image resolution with the arrangement of the recesses 50 represented by the solid lines, the first row of nozzles 24-1 and the second row of nozzles 24-2 are arranged to be spaced apart from each other by a distance indicated by W3, while the third row of nozzles 24-3 and the fourth row of nozzles 24-4 are arranged to be spaced apart from each other by the same distance indicated by W3, such that a center line X1 between the first and second rows of nozzles 24-1, 24-2 is spaced apart from a center line X2 between the third and fourth rows of nozzles 24-3, 24-4 by a distance indicated by W1. In this arrangement, the distances indicated by W1 and W3 should be set to an integral multiple of the inverse of the target image resolution value. For establishing another value of the image resolution with the other arrangement of the recesses 50 represented by the broken lines, the first row of nozzles 24-1 and the second row of nozzles 24-2 are arranged to be spaced apart from each other by a distance indicated by W4, while the third row of nozzles 24-3 and the fourth row of nozzles 24-4 are arranged to be spaced apart from each other by the same distance indicated by W4, such that the center line X1 between the first and second rows of nozzles 24-1, 24-2 is spaced apart from the center line X2 between the third and fourth rows of nozzles 24-3, 24-4 by a distance indicated by W2. In this arrangement, the distances indicated by W2 and W4 should be set to an integral multiple of the inverse of the target image resolution value.

As is apparent from FIG. 10, the distances W1 and W3 can be adjusted to the distances W2 and W4, respectively, depending on the target image resolution value, by simply changing the configurations of the recesses (horizontally extending portions) 50 and the positions of the vertically extending portions 25 and the nozzles 50. It is noted that the recesses 50 of the communication passages in each of the rows are equally configured so as to provide substantially the same degree of resistance to the ink flow.

In the present ink-jet printing head 10, the manifold portion 26 has two groups of mutually independent manifold chambers, each of which has the same length, the same depth and the same shape in the plane of the manifold plates 17, 18, as each of the manifold chambers of a cavity unit of an already developed or existing ink-jet printing head wherein the 75 nozzles (75 pressure chambers) are equally spaced apart from each other in each row extending in the longitudinal direction over a length of one inch. Namely, each of the manifold chambers 26 has a length corresponding to a half of the number (150) of the pressure chambers 23 arranged over a length of two inches along a straight line parallel to the longitudinal direction of the cavity unit 11, that is, a length corresponding to the 75 pressure chambers 23 arranged over a length of one inch.

According to the present invention, the length of the manifold chambers 26 is not increased with an increase in the number of the nozzles 24 (with an increase in the length of each row of the nozzles), but the number of the manifold chambers 26 corresponding to each row of the nozzles 24 is determined or increased depending upon the number of the nozzles 24. Accordingly, an increase in the number of the nozzles 24 in each row will not undesirably increase a resistance to the ink flow through the manifold portion (through each manifold chamber 26), which would reduce the rate or amount of supply or delivery of the ink to some of the nozzles 24. While the flow resistance of the ink can be reduced by increasing the width and/or depth of each manifold chamber 26, this solution not only results in an increase in the size of the cavity unit 11, but also requires re-designing of the nominal drive voltage, timing and waveform of the piezoelectric actuator 12, so as to prevent a cross talk between the adjacent pressure chambers 23 due to the pressure wave component of the ink propagating from the pressure chambers 23 to the manifold portion 26. In the present embodiment, however, each of the two groups of manifold chambers 26 of the manifold portion 26 which correspond to the respective two groups of pressure chambers 23 are identical in design with the manifold chambers of the manifold portion of the existing printing head. Accordingly, the piezoelectric actuator 12 of the present printing head can be operated to deliver the ink from the nozzles 24 in the same manner as in the existing printing head, by operating the piezoelectric actuator 12 with the same voltage, timing and waveform as in the existing printing head.

In the present embodiment, the two piezoelectric actuator units 12*a*, 12*b* are arranged in a spaced-apart relationship with each other in the direction of the rows of the nozzles 24, such that the opposed end faces of the two piezoelectric actuator units 12*a*, 12*b* are spaced apart from each other by a certain distance of gap (L2−2×L1). However, this distance of gap may be almost zeroed.

Thus, the present invention permits easy, economical and efficient development and manufacture of an ink-jet printing head having desired printing capability and operating accuracy (desired density of the nozzles or ink dots per inch), by utilizing a plurality of piezoelectric actuators of an existing type, and by adopting the same design (length, depth and shape in the plane of the manifold plates) of the manifold portion of the cavity unit of an existing type, even where each row of nozzles or pressure chambers in the printing head is considerably long.

It is to be understood that the number of the pressure chambers 23 (nozzles 24) and the number of the actuator units of the piezoelectric actuator 12, which correspond to the length of each manifold chamber 26, are not particularly limited, but may be determined as needed.

In the illustrated embodiment, the 150 nozzles 24 arranged in each of the four rows are held in communication with one pair of two rows of the pressure chambers 23 which lie on the same straight line parallel to the direction of the rows of the nozzles 24. Where the piezoelectric actuator 12 has two sets of the first and second actuator units 12*a*, 12*b* which are arranged in the Y-axis direction, while the cavity unit 11 has two groups (first and second groups) of pressure chambers 23 which are arranged in the X-axis direction and each of which consists of eight rows of pressure chambers 23 corresponding to the respective eight rows of the individual electrodes 36 of the corresponding two first or second actuator units 12*a*, 12*b*, the cavity unit may be provided with four rows of nozzles 24 which are formed such that 300 nozzles 24 are arranged in each of the four rows over a length of two inches and are held in communication with the four rows of pressure chambers 23 consisting of the two rows of the first group and the corresponding two rows of the second group. This modification provides a large-sized full-color ink-jet printing head, wherein the four rows of the nozzles 24 are assigned to the respective four colors, and are capable of printing a high-density image (150 dpi) having a maximum dimension of two inches in the secondary scanning direction (direction of feeding of the recording medium). Thus, the number of the rows of the active portions and the pressure chambers may be a multiple of the number of rows of the nozzles, so that the density of the nozzles in the direction of extension of the rows is a multiple of the density of the active portions and pressure chambers in the direction of extension of the rows.

In the illustrated embodiment, the ink-jet printing head 10 has the four rows of nozzles. However, the principle of the present invention is equally applicable to an ink-jet printing head having at least one row of nozzles. Further, the actuator used for the ink-jet printing head is not limited to the piezoelectric actuator 12 utilizing piezoelectric elements. However, the actuator may include oscillating plates which define the bottom walls of the pressure chambers and which are oscillated by static electricity to deliver the ink, or include Joule-heat generating elements operable according to a drive signal to generate heat for vaporizing the ink within the pressure chambers, for pressurizing the ink to be delivered from the nozzles.

While the presently preferred embodiment of this invention has been described above in detail by reference to the accompanying drawings, fro illustrative purpose only, it is to be further understood that the present invention may be embodied with various other changes, modifications and improvements, such as those described in the SUMMARY OF THE INVENTION, which may occur to those skilled in the art, without departing from the spirit and scope of the invention defined in the following claims:

What is claimed is:

1. An ink-jet printing head comprising a cavity unit and an actuator which are superposed on each other, wherein said cavity unit is a laminar structure including a plurality of plates superposed on each other in a vertical direction of said cavity unit, and has (a) a plurality of nozzles which are open in a surface thereof that is to be opposed to a print media and which are arranged in at least one row, (b) a plurality of pressure chambers which are arranged in at least one row parallel to said at least one row of said nozzles, (c) a plurality of communication passages for communication between the respective pressure chambers and the respective nozzles, and (d) a manifold portion which stores an ink supplied from an ink supply source and re-fills the pressure chambers, wherein said actuator has a plurality of active portions which correspond to said pressure chambers, respectively, and which are selectively operable to eject the ink from the corresponding nozzles, wherein said pressure chambers arranged in each of said at least one row are spaced apart from each other by a first spacing pitch, except at least one adjacent pair of said pressure chambers of said at least one row which are spaced apart from each other by a second spacing pitch that is larger than said first spacing pitch, wherein a spacing pitch of all adjacent pairs of said nozzles arranged in each of said at least one row is substantially the same, and wherein each of said communication passages includes at least one horizontally extending portion which extends in parallel with a horizontal direction of said cavity unit.

2. An ink-jet printing head according to claim 1, wherein said actuator includes of a plurality of mutually independent actuator units which are disposed such that end faces of each of at least one adjacent pair of said actuator units are opposed to each other in said direction of said at least one row of said nozzles, each of said actuator units having a length covering a predetermined number of said pressure chambers which are arranged in said direction of said at least one row of said nozzles, and wherein said end faces of each of said at least one adjacent pair of said actuator units are located between a corresponding one of said at least one adjacent pair of said pressure chambers which are spaced apart from each other by said second spacing pitch.

3. An ink-jet printing head according to claim 2, wherein said plurality of mutually independent actuator units include two actuator units as said each of said at least one adjacent pair of said actuator units, wherein said plurality of pressure chambers include two groups of pressure chambers which correspond to said two actuator units, respectively, wherein said communication passages include two groups of communication passages which are held in communication with said two groups of pressure chambers, respectively, and wherein the communication passages of one of said two groups and the communication passages of the other of said two groups are formed symmetrically with each other with respect to a plane which is parallel to said vertical direction and which is perpendicular to said direction of said at least one row of said nozzles.

4. An ink-jet printing head according to claim 1, wherein each of said communication passages consists of said at least one horizontally extending portion and at least one vertically extending portion which extends in parallel with said vertical direction of said cavity unit.

5. An ink-jet printing head according to claim 4, wherein each of said at least one horizontally extending portion is provided by a horizontally extending recess which is formed in a recess-defining plate that is one of said plates and which extends in a direction parallel to said recess-defining plate.

6. An ink-jet printing head according to claim 5, wherein each of said pressure chambers is elongated in a direction perpendicular to said direction of said at least one row of said nozzles, and is held in communication at a longitudinal end portion thereof with a corresponding one of said communication passages, and wherein said horizontally extending recess has opposite end portions, one of which is aligned with said longitudinal end portion of a corresponding one of said pressure chambers in said vertical direction of said cavity unit, and the other of which is aligned with a corresponding one of said nozzles in said vertical direction.

7. An ink-jet printing head according to claim 6, wherein one of said opposite end portions of said horizontally extending recess is larger in area than the other.

8. An ink-jet printing head according to claim 5, wherein said pressure chambers include first and second pressure chambers which are alternately arranged in said direction of said at least one row of said nozzles, wherein said communication passages include first and second communication passages which are alternately arranged in said direction of said at least one row of said nozzles, and which communicate with said first and second pressure chambers, respectively, and wherein said recess providing each of said at least one horizontally extending portion of each of said first communication passages is formed in one of opposite surfaces of said recess-defining plate, while said recess providing each of said at least one horizontally extending portion of each of said second communication passages is formed in the other of said opposite surfaces of said recess-defining plate.

9. An ink-jet printing head according to claim 8, wherein said recess providing each of said at least one horizontally extending portion of each of said first communication passages has a first depth value, while said recess providing each of said at least one horizontally extending portion of each of said second communication passages has a second depth value, and wherein a sum of said first depth value and said second depth value is smaller than a thickness value of said recess-defining plate.

10. An ink-jet printing head according to claim 9, wherein said first and second communication passages which are adjacent to each other overlap partially in a plan view of said cavity unit.

11. An ink-jet printing head according to claim 5, wherein said horizontally extending recess is formed in one of opposite surfaces of said recess-defining plate that is closer to said pressure chambers.

12. An ink-jet printing head according to claim 5, wherein said pressure chambers are formed in a pressure-chamber-defining plate which is one of said plates and which is contiguous to said recess-defining plate.

13. An ink-jet printing head according to claim 5, wherein said pressure chambers are formed in a pressure-chamber-defining plate which is one of said plates, and wherein said recess-defining plate is interposed between said pressure-chamber-defining plate and at least one of said plates in which said manifold portion is formed.

14. An ink-jet printing head according to claim 4, wherein each of said communication passages consists of a single horizontally extending portion as said at least one horizontally extending portion and a single vertically extending portion as said at least one vertically extending portion, and wherein said communication passages are the same to each other with respect to a length of said horizontally extending portion and a length of said vertically extending portion.

15. An ink-jet printing head according to claim 1, wherein said nozzles arranged in each of said at least one row are spaced apart from each other by said first spacing pitch.

16. An ink-jet printing head according to claim 1, wherein said nozzles are arranged in four rows, and wherein said active portions of said actuators are arranged in four rows each of which is parallel to a corresponding one of said four rows of said nozzles.

17. An ink-jet printing head according to claim 1, wherein said actuator includes a first piezoelectric sheet formed with individual electrodes and a second piezoelectric sheet formed with a common electrode, said first and second piezoelectric sheets being superposed on each other, and wherein said active portions are defined between said individual electrodes and said common electrode.

18. An ink-jet printing head according to claim 1, wherein said pressure chambers are arranged in two rows in a zigzag pattern, wherein said nozzles are arranged in two rows in a zigzag pattern which are located between said two rows of said pressure chambers, and wherein said communication passages are arranged in two rows in a zigzag pattern each of which is located between a corresponding one of said two rows of said nozzles and a corresponding one of said two rows of said pressure chambers.

19. An ink-jet printing head according to claim 1, wherein said plurality of communication passages have substantially the same length between said respective pressure chambers and said respective nozzles.

20. An ink-jet printing head according to claim 1, wherein the number of said pressure chambers of each of said at least one row is equal to the number of said nozzles of each of said at least one row, and wherein said pressure chambers of each of said at least one row are held in communication with said nozzles of corresponding ones of said at least one row, respectively.

21. An ink-jet printing head comprising a cavity unit and an actuator which are superposed on each other, wherein said cavity unit is a laminar structure including a plurality of plates superposed on each other in a vertical direction of said cavity unit, and has (a) a plurality of nozzles which are open in a surface thereof that is to be opposed to a print media and which are arranged in at least one row, (b) a plurality of pressure chambers which are arranged in a direction of said at least one row of said nozzles, (c) a plurality of communication passages for communication between the respective pressure chambers and the respective nozzles, and (d) a manifold portion which stores an ink supplied from an ink supply source and re-fills the pressure chambers, wherein said actuator has a plurality of active portions which correspond to said pressure chambers, respectively, and which are selectively operable to eject the ink from the corresponding nozzles, wherein said pressure chambers are arranged with a first spacing pitch between each adjacent pair of said pressure chambers, except at least one adjacent pair of said pressure chambers which are spaced apart from each other by a second spacing pitch that is larger than said first spacing pitch, wherein each of said communication passages consist of at least one horizontally extending portion which extends in parallel with a horizontal direction of said cavity unit, and at least one vertically extending portion which extends in parallel with said vertical direction of said cavity unit, and wherein each of said at least one horizontally extending portion extends in a direction inclined with respect to said direction of said at least one row of said nozzles.

22. An ink-jet printing head comprising a cavity unit and an actuator which are superposed on each other, wherein said cavity unit is a laminar structure including a plurality of plates superposed on each other in a vertical direction of said cavity unit, and has (a) a plurality of nozzles which extend in the vertical direction of said cavity unit, which are open in a surface thereof that is to be opposed to a print media, and which are arranged in at least one row, (b) a plurality of pressure chambers which are arranged in at least one row parallel to said at least one row of said nozzles, (c) a plurality of communication passages for communication between the respective pressure chambers and the respective nozzles, and (d) a manifold portion which stores an ink supplied from an ink supply source and re-fills the pressure chambers, wherein said actuator has a plurality of active portions which correspond to said pressure chambers, respectively, and which are selectively operable to eject the ink from the corresponding nozzles, wherein said nozzles arranged in each of said at least one row are spaced apart from each other by a first spacing pitch, while at least one adjacent pair of said pressure chambers arranged in each of said at least one row are spaced apart from each other by a second spacing pitch that is larger than said first spacing pitch, and wherein each of said communication passages includes at least one horizontally extending portion which extends in parallel with a horizontal direction of said cavity unit.

23. An ink-jet printing head according to claim 22, wherein each of said communication passages consists of said at least one horizontally extending portion and at least one vertically extending portion which extends in parallel with said vertical direction of said cavity unit.

24. An ink-jet printing head according to claim 23, wherein said plates include:

a nozzle-defining plate in which said nozzles are formed;

a pressure-chamber-defining plate in which said pressure chambers are formed;

a manifold-defining plate in which said manifold portion is formed and is interposed between said nozzle-defining plate and said pressure chamber-defining plate; and a recess-defining plate in which at least one horizontally extending recess that provides said at least one horizontally extending portion is formed, and which is contiguous to said pressure-chamber-defining plate and interposed between said pressure-chamber-defining plate and said manifold-defining plate, wherein said at least one horizontally extending recess extends in a direction parallel to said recess-defining plate.

25. An ink-jet printing head according to claim 23, wherein each adjacent pair of said pressure chambers are spaced apart from each other by said first spacing pitch, except said at least one adjacent pair of said pressure chambers that are spaced apart from each other by said second spacing pitch.

26. An ink-jet printing head according to claim 22, wherein the number of said pressure chambers of each of said at least one row is equal to the number of said nozzles of each of said at least one row, and wherein said pressure chambers of each of said at least one row are held in communication with said nozzles of corresponding ones of said at least one row, respectively.

* * * * *